US009914519B2

(12) United States Patent
Nutz et al.

(10) Patent No.: US 9,914,519 B2
(45) Date of Patent: Mar. 13, 2018

(54) PROPULSION SYSTEM FOR A WATERCRAFT

(71) Applicant: Confluence Outdoor, LLC, Greenville, SC (US)

(72) Inventors: Hans Eric Nutz, Easley, SC (US); Lee Patrick Ward, Gaffney, SC (US); Brian Karcher, Greenville, SC (US); Matthew Montaruli, Greenville, SC (US); Louis Rondeau, Greenville, SC (US)

(73) Assignee: Confluence Outdoor, LLC, Greenville, SC (US)

( * ) Notice: Subject to any disclaimer, the term of this patent is extended or adjusted under 35 U.S.C. 154(b) by 0 days.

(21) Appl. No.: 15/198,903

(22) Filed: Jun. 30, 2016

(65) Prior Publication Data

US 2018/0001986 A1 Jan. 4, 2018

(51) Int. Cl.

| | |
|---|---|
| ***B63H 5/20*** | (2006.01) |
| ***B63H 5/125*** | (2006.01) |
| ***B63H 20/08*** | (2006.01) |
| ***B63H 21/30*** | (2006.01) |
| ***B63H 21/00*** | (2006.01) |
| ***B63H 16/20*** | (2006.01) |

(52) U.S. Cl.

CPC ..... *B63H 21/30* (2013.01); *B63H 16/20* (2013.01); *B63H 21/24* (2013.01); *B63H 2016/202* (2013.01)

(58) Field of Classification Search

CPC ..... B63H 16/12; B63H 16/14; B63H 16/20; B63H 2016/20; B63H 2016/202; B63H 20/02; B63H 20/04; B63H 20/06; B63H 2020/02; B63H 2020/10; B63H 21/21; B63H 21/24; B63H 21/26; B63H 21/30; B63H 2021/30; B63H 2021/307

USPC .... 114/343, 363, 364; 440/111, 112, 53, 54, 440/55, 56, 62, 63, 65

See application file for complete search history.

(56) References Cited

U.S. PATENT DOCUMENTS 1,616,180 A 2/1927 Ford
1,659,580 A 2/1928 Weller
(Continued)

FOREIGN PATENT DOCUMENTS

WO 2016196480 12/2016

OTHER PUBLICATIONS

European Search Report for Application No. 17178133.9, dated Oct. 26, 2017, 10 pgs.

*Primary Examiner* — Daniel V Venne
(74) *Attorney, Agent, or Firm* — Womble Bond Dickinson (US) LLP

(57) ABSTRACT

A mount for mounting a drive module to a watercraft is described herein. The mount in-use with the drive module is also described. The mount in-use with the drive module and the watercraft is also described. The mount includes a frame configured to be attached to the watercraft. The mount is also configured to attach to the drive module to selectively allow the drive module to translate from a first position to a second position. When in the first position, the drive module is capable of propelling the watercraft. The frame has a retainer to fix the drive module in the first position and a first spring to assist translation of the drive module toward the second position. The second position is a relatively raised position compared to the first position.

22 Claims, 13 Drawing Sheets

(56) References Cited

U.S. PATENT DOCUMENTS

| | | | | |
|---|---|---|---|---|
| 1,843,823 | A | 2/1932 | Kohn | |
| 2,099,544 | A | 11/1937 | Strezoff | |
| 2,420,422 | A | 5/1947 | Gilliam | |
| 3,083,382 | A | 4/1963 | Havens et al. | |
| 3,352,276 | A | 11/1967 | Zimmerman | |
| 3,965,844 | A | 6/1976 | Brock et al. | |
| 3,987,749 | A | 10/1976 | Anderson | |
| 4,154,417 | A | 5/1979 | Foley, Jr. | |
| 4,459,116 | A | 7/1984 | Moore | |
| 4,634,390 | A * | 1/1987 | Baird | B63H 20/007 248/642 |
| 4,648,846 | A | 3/1987 | Hsu | |
| 4,759,308 | A | 7/1988 | Zander | |
| 5,038,698 | A | 8/1991 | Winner | |
| 5,081,947 | A | 1/1992 | Holden | |
| 5,112,258 | A | 5/1992 | Folsom | |
| 5,195,915 | A | 3/1993 | Namur | |
| 5,277,630 | A | 1/1994 | Clark | |
| 5,362,264 | A | 11/1994 | Parant | |
| 5,651,706 | A | 7/1997 | Kasper | |
| 5,669,794 | A | 9/1997 | Knight et al. | |
| 6,165,030 | A | 12/2000 | Lewis | |
| 6,210,242 | B1 | 4/2001 | Howard et al. | |
| 6,213,821 | B1 | 4/2001 | Bernloehr et al. | |
| 6,280,267 | B1 | 8/2001 | Griffith, Sr. et al. | |
| 6,325,685 | B1 | 12/2001 | Knight et al. | |
| 7,887,381 | B2 | 2/2011 | Brass et al. | |
| 7,972,188 | B2 | 7/2011 | Bernloehr et al. | |
| 8,337,266 | B2 | 12/2012 | Ellis et al. | |
| 8,342,897 | B2 | 1/2013 | Gater et al. | |
| 8,430,047 | B1 | 4/2013 | Dill | |
| 8,439,715 | B1 | 5/2013 | Clark | |
| 8,677,919 | B2 | 3/2014 | Bernloehr et al. | |
| 8,753,156 | B2 | 6/2014 | Ketterman et al. | |
| 8,936,498 | B1 | 1/2015 | Lee | |
| 9,187,152 | B2 | 11/2015 | Bailey et al. | |
| 9,758,220 | B1 | 9/2017 | Zimmerman et al. | |
| 2002/0152940 | A1 | 10/2002 | King | |
| 2005/0255761 | A1 * | 11/2005 | Bernloehr | B63H 20/007 440/6 |
| 2005/0279912 | A1 * | 12/2005 | Kozubski | B63H 20/106 248/642 |
| 2007/0232157 | A1 | 10/2007 | Lee | |
| 2008/0060569 | A1 | 3/2008 | Howard et al. | |
| 2009/0042461 | A1 | 2/2009 | Walton | |
| 2014/0053765 | A1 | 2/2014 | Phillips, Jr. | |
| 2015/0298782 | A1 | 10/2015 | Bernloehr et al. | |
| 2015/0314848 | A1 | 11/2015 | Lyons et al. | |
| 2015/0367914 | A1 | 12/2015 | McDonough et al. | |
| 2016/0200404 | A1 | 7/2016 | Orenes Lopez | |
| 2016/0288891 | A1 * | 10/2016 | Nyren | B63H 20/06 |

* cited by examiner

PROPULSION SYSTEM FOR A WATERCRAFT

FIELD OF DISCLOSURE

The present disclosure relates to small watercraft, including but not limited to kayaks, canoes, paddle boards, etc. More particularly this disclosure relates to small watercraft that have a propulsion system. Further still, this disclosure relates to a mount for attaching the propulsion system to the watercraft.

BACKGROUND

Outdoor enthusiasts embrace watersports. In the category of watercraft fishing, anglers are moving from large and cumbersome power boats to smaller personal watercraft such as kayaks. Fishermen are rediscovering the accessibility, portability, quiet travel, and lower cost of fishing from canoes and kayaks as was common hundreds of years ago. These small watercraft can travel into shallow water, marshes, and through narrow passages that larger boats cannot. Kayak fishing provides access to bodies of water that may be off limits to power boats. Traveling in a kayak is often quieter above and below the water, and thus helps to avoid alerting the fish below. Anglers who use kayaks also spend less time and effort transporting, launching, pulling, and maintaining their boats, resulting in more time on the water catching fish.

While more and more anglers are turning to the benefits of kayak fishing, many of the anglers would prefer to avoid having to paddle their boat from fishing spot to fishing spot. Paddling occupies the angler's hands, limiting the ability of the angler to simultaneously fish and move their boat. Additionally, paddling is physically demanding, and some anglers may prefer a more leisurely fishing experience. To address these concerns, several propulsion systems have been developed for kayaks and other small boats. These propulsion systems include pedal-powered propulsion systems, where the angler is able to pedal with their feet or hands. The act of pedaling drives at least one blade, such as a propeller or flippers, to move the boat through the water. These pedal-powered propulsion systems allow the angler to move the boat, staying on the fish, while remaining seated and while keeping their hands free for reeling in their catch. Also, many users find propelling the boat with their legs to be easier than having to paddle with an oar. The pedal-powered systems also avoid running short on gas or battery power while on the water.

Other propulsion systems use electric motors to drive the blades. These systems are sometimes referred to as trolling motors. Use of a trolling motor may provide the accessibility of kayak fishing combined with the hands-free transportation of a power boat. Trolling motors generally require rechargeable battery packs to operate the electric motors.

While these propulsion systems exist, there remains a need for an improved system to mount these propulsion systems to the watercraft in a manner that may improve versatility and user experience on the water.

SUMMARY

An embodiment of the present disclosure includes a mount for mounting a drive module to a watercraft. The mount comprises a frame configured to be attached to the watercraft and configured to attach to the drive module to selectively allow the drive module to translate from a first position to a second position. When in the first position, the drive module is capable of propelling the watercraft. The frame comprises a retainer to fix the drive module in the first position and a first spring to assist translation of the drive module toward the second position. The second position is a raised position relative to the first position.

Other embodiments of the present disclosure include a propulsion system for a watercraft. The propulsion system comprises a drive module and a mount for mounting the drive module to the watercraft. The drive module comprises an actuation portion accessible to a user for receiving an input, a propulsion portion having at least one blade to propel the watercraft in response to the input, and an intermediate portion between the actuation portion and the propulsion portion. The intermediate portion is capable of extending at least partially through the watercraft. Further, the mount comprises a frame configured to be attached to the watercraft and configured to attach to the intermediate portion of the drive module to selectively allow the drive module to translate from a first position to a second position. The frame comprises a retainer to fix the drive module in the first position and a first spring to assist translation of the drive module toward the second position.

Embodiments of the present disclosure also include the propulsion system within a watercraft, where the frame is attached to the shell of the watercraft adjacent to a scupper. The first position of the drive module is an in-use position where the intermediate portion extends through the scupper and the propulsion portion extends below the hull. The second position of the drive module is a raised position with the propulsion portion substantially located within the scupper.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art. All such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
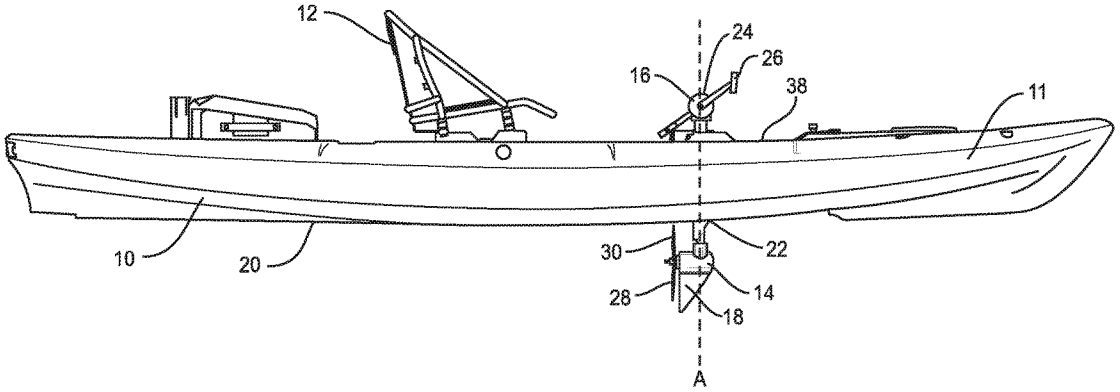
FIG. 1 is a profile view of a watercraft with a drive module in an in-use position.

FIG. 1 shows a watercraft 10 in the form of a sit on top fishing kayak with a shell 11 and a seat 12. The features and benefits of the present disclosure are not necessarily limited to sit on top kayaks, but may be applicable to other small watercraft such as sit in kayaks, inflatable kayaks, canoes, paddle boards, inflatable paddle boards, jon boats, etc. The watercraft 10 has a drive module 14. The drive module 14 is shown in an in-use position. The drive module 14 has an actuation portion 16 accessible to the user. The actuation portion 16 receives a input from the user. Examples of user input include buttons or switches to send an electrical signal, or manual motions such as the rotation or pumping of pedals. The drive module 14 has a propulsion portion 18 capable of being positioned below the hull 20 of the shell 11 of the watercraft 10 to act upon the water and propel the watercraft. The propulsion portion 18 includes blades provided in the form of a rotating propeller or oscillating flippers to exert a force on the water in response to the user input. The drive module 14 may have an intermediate portion 22, such as a stem, provided between the actuation portion 16 and the propulsion portion 18 to pass through the watercraft 10. In one example, the intermediate portion extends through a scupper as discussed below.

Figure 3:
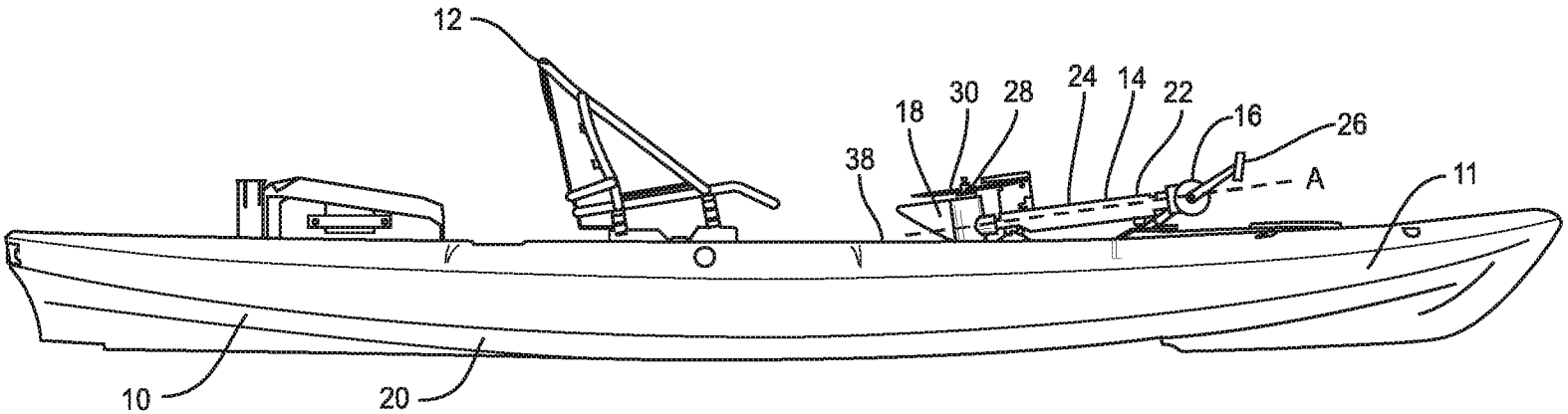
FIG. 3 is a profile view of the watercraft with the drive module in a stowed position.
Figure 4:
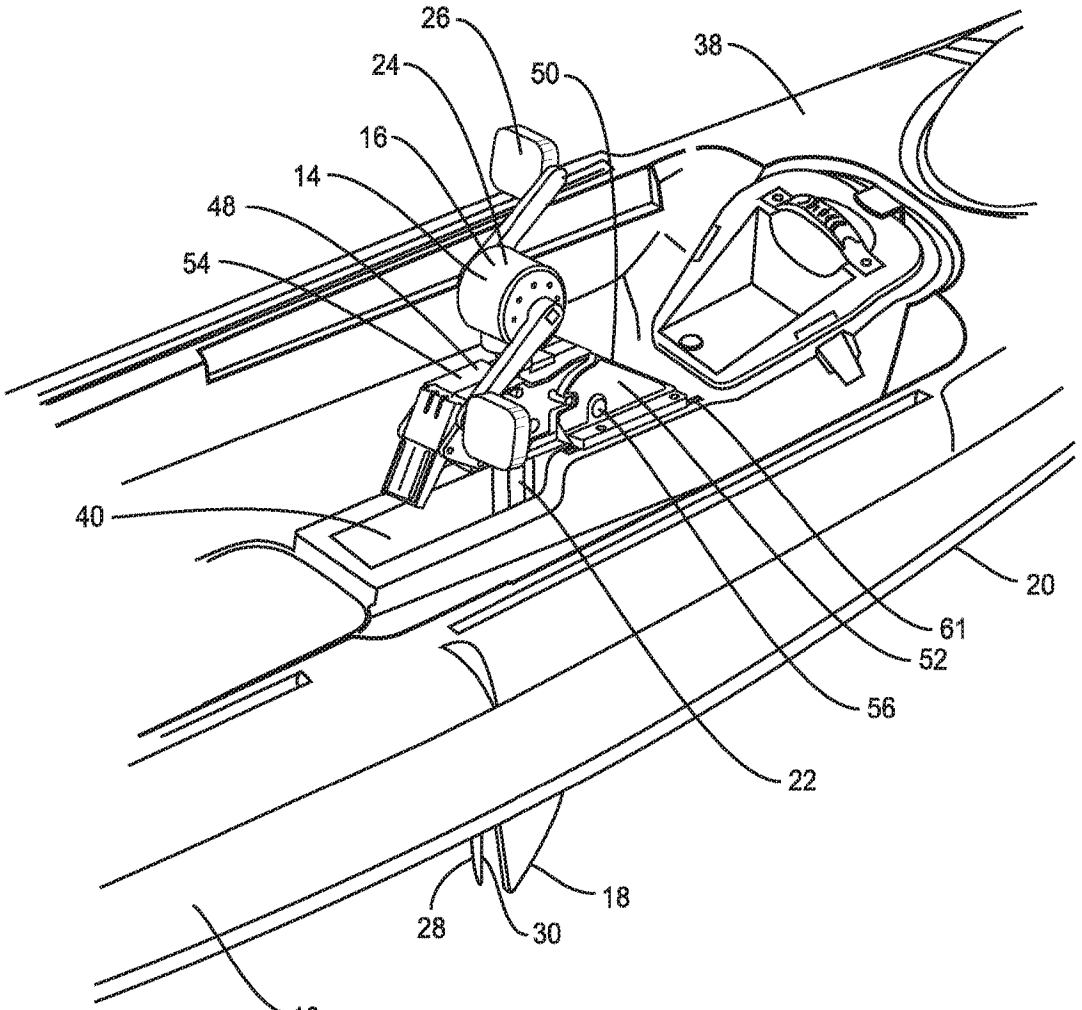
FIG. 4 is a top perspective view of the watercraft with the drive module in the in-use position.
Figure 5:
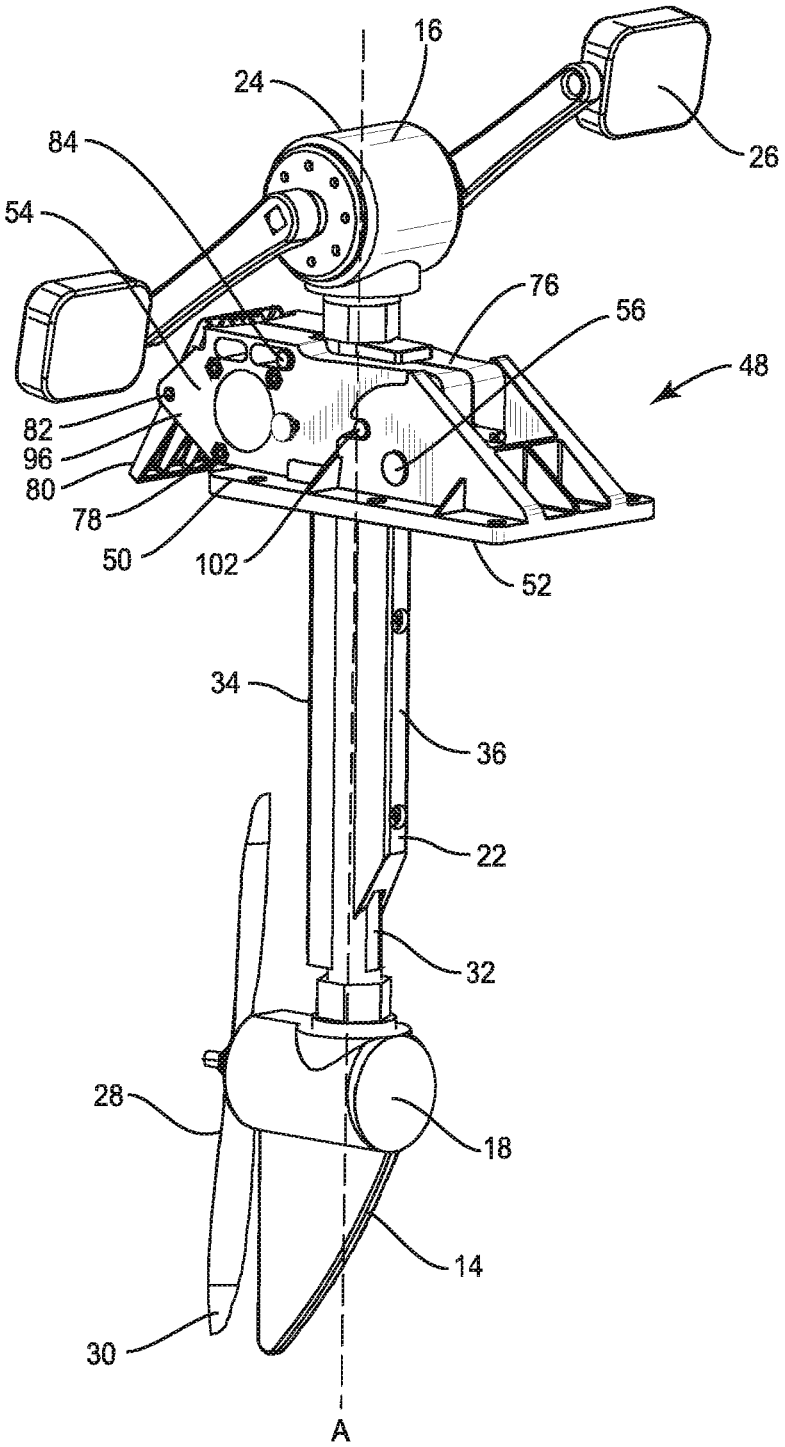
FIG. 5 is a front perspective view of a propulsion system for the watercraft with the drive module in the in-use position.
Figure 6:
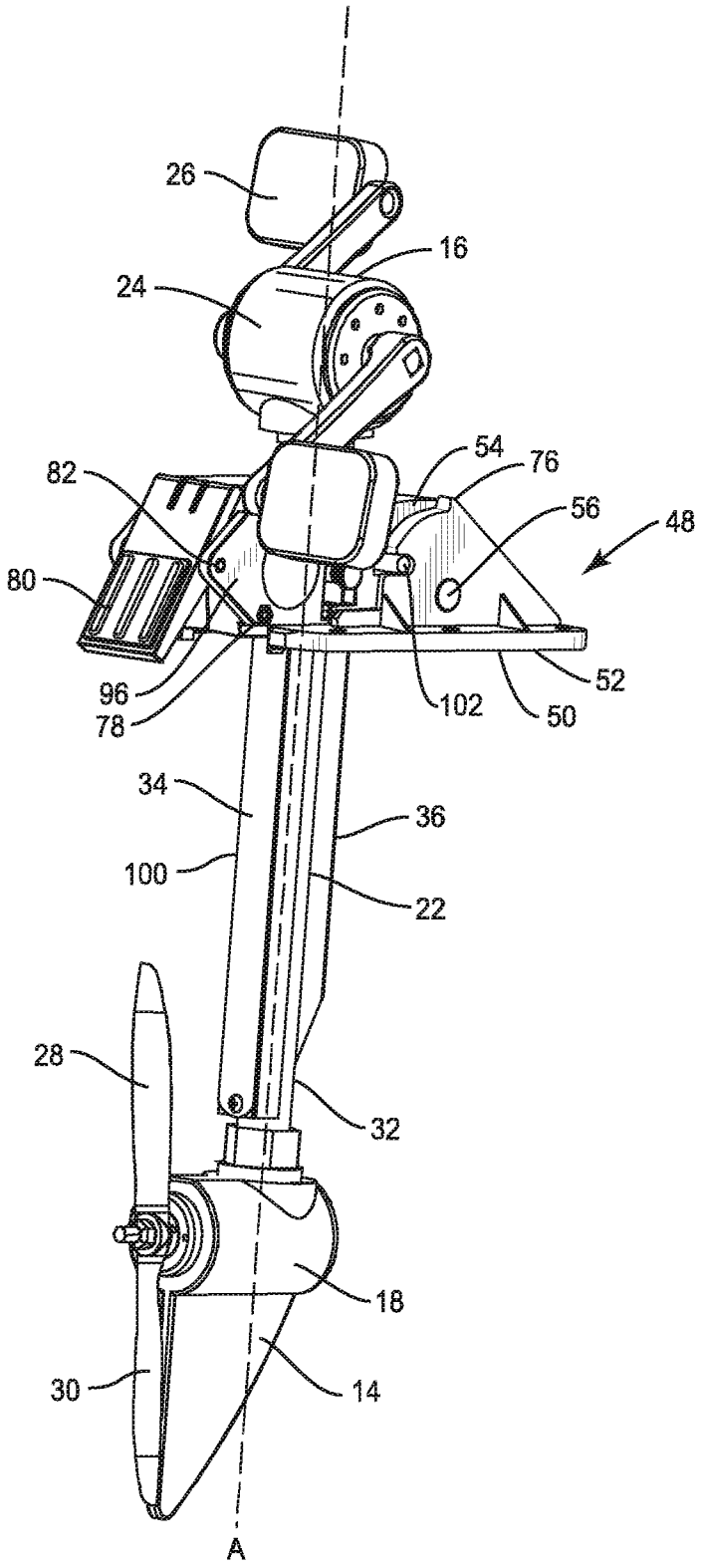
FIG. 6 is a rear perspective view of a propulsion system for the watercraft with the drive module in the in-use position.

As shown in FIGS. 1-6, the drive module 14 may comprise a pedal drive 24. The actuation portion 16 of the pedal drive 24 includes a pair of pedals 26 attached to respective rotary crank arms. As used herein, the term "pedal" may include both the crank arm and the foot pad portions. In other embodiments, the pedals are operated with a pumping motion. The propulsion portion 18 of the pedal drive 24 includes a propeller 28, such as a two-blade propeller having two diametrically opposed blades 30. The intermediate portion 22 may include a conduit 32, a guide 34 and a spacer 36 as seen in FIGS. 5 and 6. The conduit 32, the guide 34, and the spacer 36 may be formed as an integral component or may be formed as two or three individual components assembled together.

The pedals 26 are configured to be operably connected with the propeller 28, such that rotation of the pedals causes rotation of the propeller, thus driving the watercraft 10 through the water. In some embodiments, an internal drive train having bevel gears and a drive rod passing through the conduit 32 may convey motion from the pedals 26 to the propeller 28. In an embodiment, rotation of the pedals 26 in a first direction propels the watercraft 10 in a forward direction. Similarly, rotation of the pedals 26 in another, opposite direction, propels the watercraft 10 in a reverse direction. In some embodiments, rotation of the pedals 26 may be fixed relative to rotation of the propeller 28. In other words, there may be a direct relationship between the position of the pedals 26 and the orientation of the propeller 28. For example, in the in-use position of the drive module 14 shown in FIG. 1, if the crank arms of the pedals 26 are arranged substantially vertically, the pair of blades 30 on the propeller 28 may be similarly arranged vertically.

The drive module 14 of the illustrated embodiment is a pedal drive 24. On the other hand, drive modules 14 according to the present disclosure are not necessarily limited to pedal drives 24. For example, a trolling motor may be used in place of the pedal drive 24. The trolling motor could similarly include an actuation portion accessible from within the boat, such as a control switch or a steering handle. An intermediate portion of the trolling motor would pass through the watercraft 10 when in-use. The trolling motor could also have a propulsion portion having a propeller attached to an electric motor to propel the watercraft at the command of the control switch.

Again, FIG. 1 shows the drive module 14 in an in-use position relative to the watercraft 10. This position may also be referred to as the pedal position of the pedal drive 24. As an example, the drive module 14 may extend below the hull 20 of the watercraft 10, creating a draft of approximately sixteen inches, in the in-use position.

Figure 2:
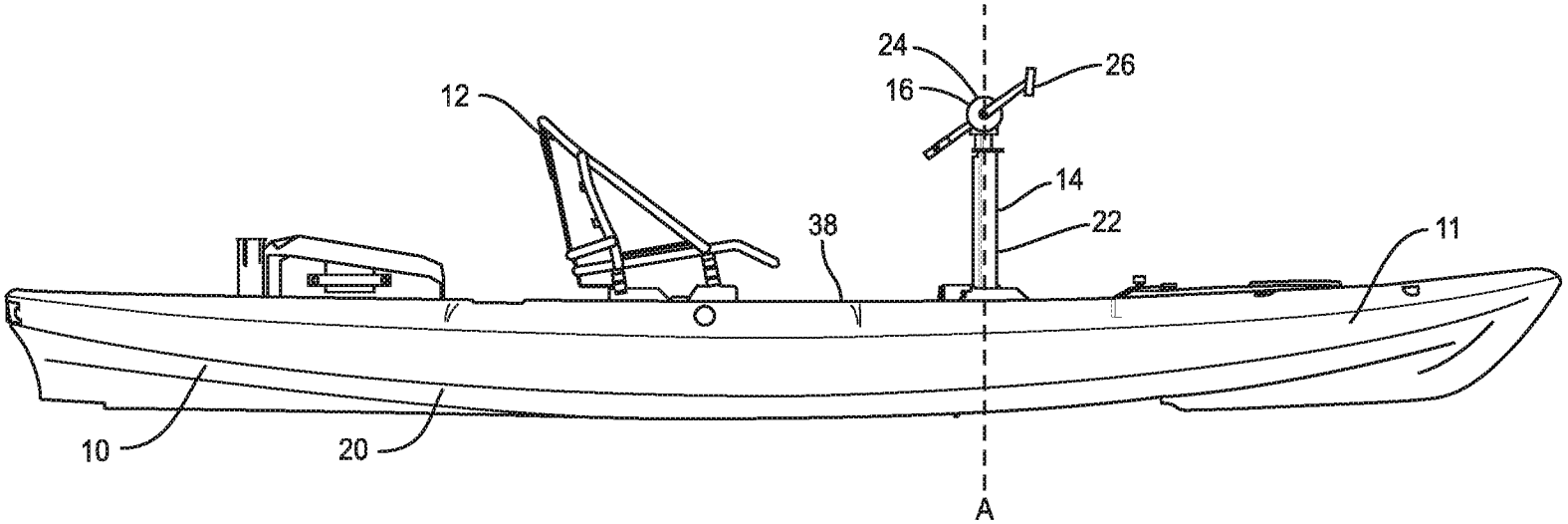
FIG. 2 is a profile view of the watercraft with the drive module in a raised position.

FIG. 2 shows the drive module 14 in a raised position relative to the watercraft 10. In one embodiment, the drive module 14 translates (e.g. slides) generally linearly between the in-use position and the raised position, and vice versa. In some embodiments, translation of the drive module 14 occurs along a longitudinal axis A that passes through the intermediate portion 22 of the drive module. In some embodiments, the raised position may also be referred to as the low-draft position, or even the zero-draft position. For example, if the blades 30 (see FIG. 1) of the propeller 28 are in a pre-determined orientation, e.g. vertical, the drive module 14 may be able to rise from the in-use position by a sufficient magnitude for the propulsion portion 18 of the drive module to fit within the side profile of the watercraft 10, resulting in substantially zero draft. If the blades 30 of the propeller 28 are significantly rotated with respect to the pre-determined orientation, however, the blades 30 may contact the bottom of the hull 20 and prevent the drive module 14 from being fully raised. This would result in a low-draft position until the orientation of the blades 30 can be adjusted. In one instance, the low-draft position may account for approximately four inches of draft. In an embodiment, the propeller 28 may be removably attached to the propulsion portion 18 so that the user is able to set the desired pre-determined orientation between the pedals 26 and the blades 30. It is expected that vertically oriented pedals 26 may preferably correspond with vertically oriented blades 30 in the in-use position because vertically oriented pedals may be allow a more low profile when the drive module 14 is rotated into a stowed position.

FIG. 3 shows a profile view of the watercraft 10 with the drive module 14 in the stowed position. The stowed position may orient the drive module 14 in a substantially horizontal position relative to a deck 38 of the watercraft 10. The longitudinal axis A may be substantially horizontal in the stowed position, as opposed to being substantially vertical when the drive module 14 is in the in-use or raised positions. The stowed position may be achieved by rotating the drive module 14 from the fully raised or zero-draft position. The stowed position may be designed to position the drive module 14 in a position that minimizes inconvenience for the user. This is at least partially achieved by orienting the drive module 14 low to the deck 38 of the shell 11 while having the actuation portion 16 of the drive module 14 moved further forward, away from the user, relative to the in-use position.

The combination of a watercraft 10 and a drive module 14 are not limited solely to a drive module 14 that achieves the three positions as shown in FIGS. 1-3. In an alternative embodiment, the drive module 14 may be capable of the in-use and raised positions shown, but may not be pivoted onto the deck in a stowed position. This may be the case where the raised position results in a substantially zero-draft position. In another embodiment, the drive module 14 may achieve a stowed, substantially zero-draft position by pivoting the intermediate portion 22 less than 90 degrees from vertical, without or without first translating the intermediate portion vertically. Therefore the drive module 14 may have substantially two positions, an in-use position with the intermediate portion substantially vertical and a stowed position where the intermediate portion is angled less than 90 degrees from vertical such that the propulsion portion 18 resides at least partially within a cavity in the hull 20.

As seen in FIG. 4, the watercraft 10 includes a scupper 40 passing through the shell 11 and exiting the hull 20 of the watercraft. the scupper 40 may be generally centered along the width of the watercraft 10. The scupper 40, and thus the drive module 14 should be positioned for comfortable use along the fore-aft direction of the watercraft 10. The scupper 40 may be located slightly forward of center along the fore-aft direction to allow the actuation portion 16 of the drive module 14 to be a comfortable distance ahead of a seated user when the drive module is in the in-use position. In some embodiments, the seat 12 (FIG. 1) may be capable of adjusting along the fore/aft direction so the drive module 14 may be used by anglers of various heights.

In some embodiments, at least the propulsion portion 18 and the intermediate portion 22 (FIG. 1) of the drive module 14 should have a slim profile along the width direction of the watercraft 10 to allow for insertion through the scupper 40 (FIG. 4). The width of the scupper 40 should be minimized to maximize floor and deck area for the watercraft 10. The slim width of the drive module 14 provides a streamlined shape for minimizing resistance as the propulsion portion 18 cuts through the water. In one embodiment, the scupper 40 may be between about 3.5 inches and about 6 inches wide and between about 13 inches and about 18 inches long.

FIG. 4 shows an upper perspective view of the watercraft 10 with the drive module 14 in the in-use position. FIG. 4 shows the drive module 14 attached to the watercraft 10 using a mount 48. The combination of the drive module 14 and the mount 48 may be referred to as the propulsion system. FIGS. 5 and 6 show front and rear perspective views of the mount 48 with the drive module 14 in the in-use position. The mount 48 includes a frame 50 that may be formed by the combination of a mounting bracket 52 and a pivot bracket 54. The pivot bracket 54 may be secured to and retain the drive module 14. The pivot bracket 54 may be removably attached to the mounting bracket 52 by a pivot pin 56. Removing the pivot pin 56, which may be retained by a cotter pin as is known in the art, allows the drive module 14 to be removed from the watercraft 10 while the mounting bracket 52 remains with the boat. When attached to the mounting bracket 52, the pivot bracket 54 may be capable of selectively pivoting or rotating with respect to the mounting bracket 52 to transition the drive module 14 from the raised position (FIG. 2) to the stowed position (FIG. 3A) and vice versa. In some embodiments, the frame 50 may constitute a single bracket, particularly where achieving a stowed position by pivoting is not required. In still other embodiments, the mounting bracket 52, or its function of holding the pivot bracket 54, may be integrated with the shell 11 such that the frame 50 primarily constitutes the pivot bracket.

Figure 7:
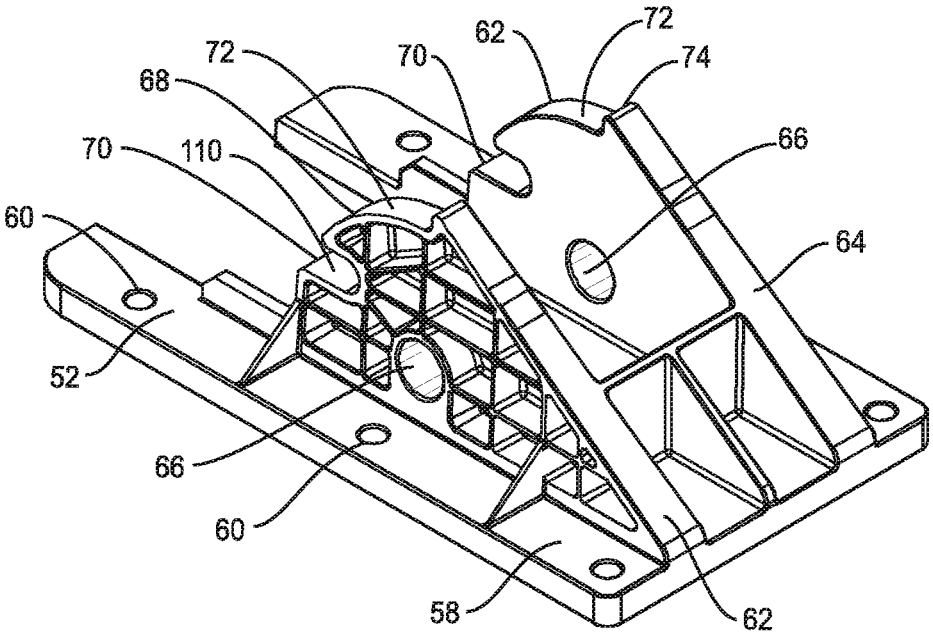
FIG. 7 is a front perspective view of a mounting bracket according to an embodiment of the propulsion system.

FIG. 7 is a detailed view of the mounting bracket 52 according to an embodiment of the present disclosure. The use of a mounting bracket 52 may allow for after-market attachment of the propulsion system to the watercraft 10. In other embodiments the mounting bracket 52 may be integrated with the shell 11 during manufacturing. The mounting bracket 52 of the illustrated embodiment may include a base 58 having a series of apertures 60 configured to accept fasteners for fixing the mounting bracket 52 to the deck 38, floor or console of the watercraft 10. In an embodiment, the mounting bracket 52 may be positioned adjacent to and at least partially forward of the scupper 40 (FIG. 4). In one embodiment, the mounting bracket 52 may be mounted to the deck 38 via one or more slide tracks 61 (shown in FIG. 4) or other known structure used to mount accessories to watercraft. As such, the mounting bracket 52 may be capable of being adjusted forward and aft relative to the deck 38. This forward/aft adjustment may help locate the drive module 14 in a comfortable location for the user.

One or more support flanges 62 may extend upwardly from the base 58 of the mounting bracket 52. A leading edge 64 of each support flange 62 may be tapered to minimize wind resistance when mounted to the watercraft 10. A pivot bore 66 may pass through each support flange 62 for accepting the pivot pin 56 (FIG. 6), which may be configured to removably and pivotably attach the pivot bracket 54 to the mounting bracket 52. The trailing edge 68 of at least one of the support flanges 62 may include a catch 70, in the form of a notch extending into the trailing edge 68. The trailing edge 68 may also include an arcuate guide surface 72 and a projection to act as a stop 74.

Returning to FIGS. 5 and 6, the pivot bracket 54 may include a housing 76 configured to at least partially surround the intermediate portion 22 of the drive module 14. In the illustrated embodiment, the housing 76 comprises two halves connected by fasteners 78 to sandwich the drive module 14. In one embodiment, a foot lever 80 is pivotably mounted to the housing 76 using a lever pin 82. The foot lever 80 may function in some embodiments as a release or a quick-release. The release function described below may be performed by a pull handle or press button as alternatives to the foot lever 80 of the illustrated embodiment.

Figure 8:
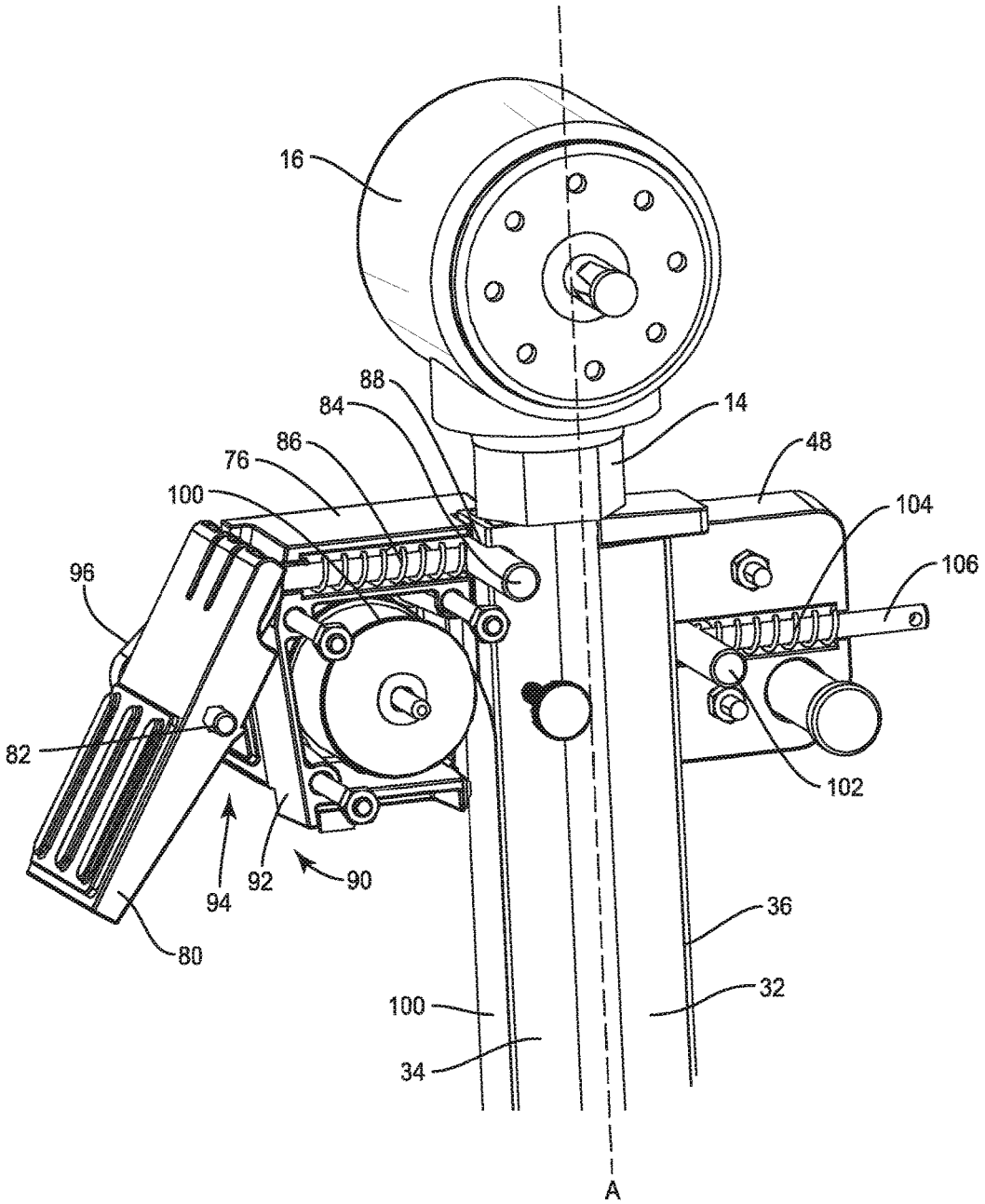
FIG. 8 is a partial assembly view of the propulsion system with the drive module in the in-use position.

FIG. 8 shows a partial assembly of the mount 48, with the mounting bracket 52 and half of the housing 76 omitted to highlight the internal mechanism of the pivot bracket 54 according to one embodiment. As shown, the foot lever 80 may pivot around an axis through the lever pin 82. In the illustrated embodiment, the foot lever 80 is operably connected to a retainer pin 84. The retainer pin 84 may be biased inward, i.e. toward the drive module 14, by a retainer spring 86, such as a compression spring. The retainer pin 84 may be configured to engage one or more retainer notches 88 formed in the drive module 14 to temporarily fix a relative translational position of the drive module. The retainer notches 88 may be formed at one or more locations along the guide 34 of the intermediate portion 22 of the drive module 14. For example, the guide 34 may include a first retainer notch 88 near the actuation portion 16 of the drive module 14. As seen in FIG. 8, the retainer pin 84 engages with the retainer notch 88 when the drive module 14 is in the in-use position. Another retainer notch (not shown) may be provided near the propulsion portion 18 of the drive module 14. The retainer pin 84 may engage the second retainer notch when the drive module 14 reaches the fully raised position.

In some embodiments, additional retainer notches may be provided along the guide 34 to provide incremental translational raised and lowered positions of the drive module 14 relative to the pivot bracket 54 and frame 50.

Figure 9:
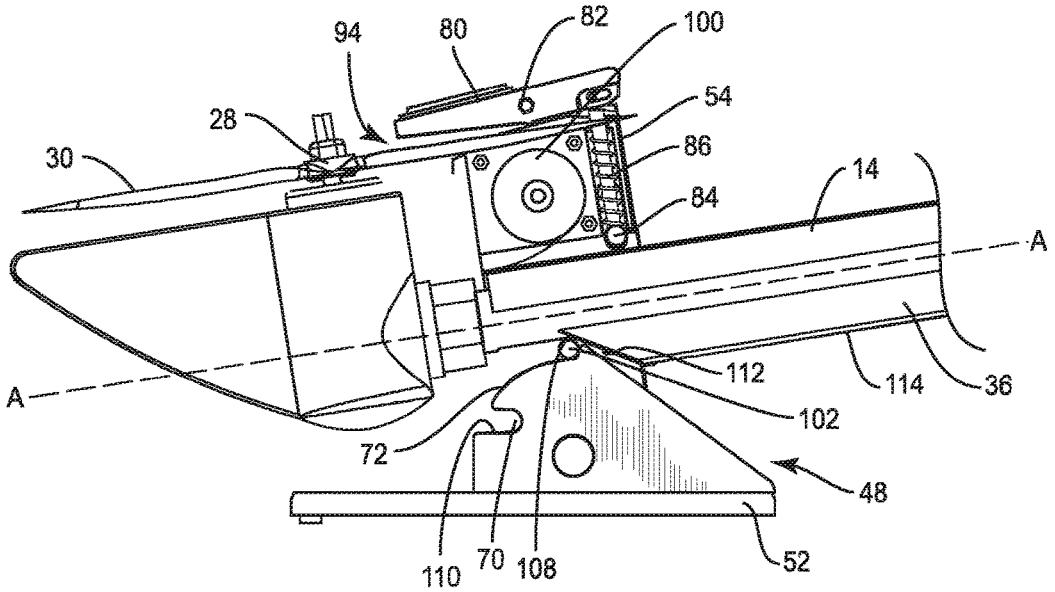
FIG. 9 is another partial assembly view of the propulsion system with the drive module in the stowed position.

Staying with FIG. 8, a gap 90 may occur between a lower portion of the foot lever 80 and a wall 92 of the housing 76. This gap 90 may lead to a cavity 94. One of the blades 30 of the propeller 28 may extend into the cavity 94 when the drive module 14 is moved to the fully raised position as shown in FIG. 9. The cavity 94 may be bounded by wings 96 that extend from the housing 76 to support the lever pin 82 as shown in FIG. 8. Therefore, when the blade 30 is within the cavity 94, the rotation of the propeller 28 may be restricted. Restricting propeller motion may similarly restrict pedal motion, limiting the potential to inadvertently spin the propeller 28 or the pedals 26.

In one embodiment, a restoring force may be provided by a constant force spring 100 to assist with translating (e.g. lifting) the drive module 14 toward the raised position (FIG. 2). As is known in the art, a constant force spring may be formed by a roll of spring steel that is relaxed in a fully rolled position. The constant force spring 100 may have one end rotatably mounted within the housing 76 and the other end attached to the drive module 14, such as at a location near the propulsion portion 18 as seen in FIG. 6. The restoring force provided by a constant force spring is substantially constant as the roll is unrolled and the fixed end is spaced from the rolled end. This is in contrast to most other springs, which follow Hooke's law, where the restoring force increases proportionally with the separation of the spring's ends. While a constant force spring 100 is shown in FIG. 8, a spring that follows Hooke's law may also be used.

In the in-use position of the drive module 14, with the propulsion portion 18 spaced from the pivot bracket 54, the constant force spring 100 is unrolled, resulting in a restoring force being applied to the drive module 14. The restoring force attempts to roll up the constant force spring 100 and lift the propulsion portion 18 toward the pivot bracket 54. While a constant force spring 100 is shown, other types of springs or elastic components may be used to provide a force upon the drive module 14 toward the raised position.

In view of the above described structural elements, translating the drive module 14 from the in-use position to the raised position may occur as follows: a user may press a lower portion of the foot lever 80, causing the foot lever to pivot around the lever pin 82. The upper portion of the foot lever 80 then imparts a force in opposition to the biasing force of the retainer spring 86, retracting the retainer pin 84 to disengage from the retainer notch 88. Use of an alternative release besides a foot lever 80, capable of retracting the retainer pin 84, is possible. An example of an alternative release includes a pull handle or an interconnected push-button actuator.

In one embodiment, the constant force spring 100 acts as a lift assist. When the drive module is no longer fixed in place by engagement between the retainer pin 84 and the retainer notch 88, the restoring force provided by the constant force spring 100 supplements efforts by the user to pull the drive module 14 toward the raised position. The mechanical lift assist provided by the constant force spring 100 (or other type spring) limits the effort necessary from the user to pull up the drive module 14. This is beneficial because leverage may be limited by reduced stability as the watercraft 10 floats upon the water. Using a spring based mechanical system results in reduced costs, reduced weight, and avoidance of electrical power that would be required to operate an electric lift. An upper travel limit of the drive module 14 may occur when the retainer pin 84 engages a second retainer notch. An upper travel limit may also be provided by contact between a portion of the drive module 14 and the housing 76 of the pivot bracket 54.

In some embodiments, the constant force spring 100 (or a spring that follows Hooke's law) biases the drive module 14 toward the raised position in a sufficient manner to provide a mechanical auto-lift function. In this embodiment, when the engagement between the retainer pin 84 and retainer notch 88 no longer opposes the restoring force of the constant force spring 100, the drive module 14 will be pulled upwardly by the restoring force of the constant force spring. The foot lever 80 may act as a quick release, e.g. a release that substantially simultaneously triggers another action, in this case upward motion of the drive module 14. Particular use of a foot lever 80 as a release or quick-release may allow the drive module 14 to translate from the in-use position to the raised position in an auto-lift or hands-free manner.

In the auto-lift embodiment, the constant force spring 100 is configured to provide sufficient force to raise the drive module 14 when the retainer pin 84 is disengaged from the retainer notch 88. The restoring force should be sufficient to exceed the combined forces of gravity on the drive module 14 and any drag that occurs between the propulsion portion 18 and the water. The constant force spring 100 should be configured to provide a biasing, restoring force of a magnitude that avoids having the drive module 14 jump upwardly at high speed. For example, the constant force spring 100 may be designed to raise the drive module 14 at a rate of less than about 1 ft/sec, preferably between about 0.5 ft/sec and about 0.75 ft/sec. A biasing force of between about 15 lbs. and about 20 lbs. may provide the desired rate of assentation.

As alluded to above, transitioning from the in-use position (FIG. 1) to the fully raised position (FIG. 2) of the drive module 14 may require the additional step of positioning the propeller 28 in a predetermined orientation, e.g. with the blades 30 aligned with the intermediate portion 22. In the case of the pedal drive 24, aligning the propeller 28 may involve rotating the pedals 26, particularly the crank arms thereof, into a predetermined orientation relative to the intermediate portion 22.

To transition (e.g. translate) the drive module 14 from the raised position back to the in-use position, the user may disengage the retainer pin 84 from a second retainer notch, if applicable, by pressing the foot lever 80. In most embodiments, the foot lever 80 does not need to be pressed in order to lower the drive module 14 back to the in-use position. The user may then press down upon the drive module 14 in opposition to the restoring force of the constant force spring 100 until the retainer pin 84 engages the first retainer notch 88.

FIGS. 8 and 9 illustrate the operation of a locking pin 102 configured to selectively allow or prevent the pivot bracket 54 from rotating relative to the mounting bracket 52. The locking pin 102 may be biased inwardly (e.g. toward the longitudinal axis A) by a locking spring 104, for example a compression spring. As used herein, the term "spring" used generically to refer to any of elements 86, 100 and 104 may include any suitable structure capable of storing elastic potential energy and providing a desired restoring force. Therefore the term "spring" includes but is not limited to coil springs, torsion springs, compression springs, extension springs, constant force springs, and other resilient elastic members such as rubber bands and the like.

A pin extension 106 may extend from the housing 76 of the pivot bracket 54 for access by the user. In the illustrated embodiment, the spacer 36 of the intermediate portion 22 of the drive module 14 is configured to interact with the locking pin 102 to pivotably retain the position of the drive module in the in-use position, and to allow for pivoting of the drive module in the fully raised position. For example, as seen in FIG. 9, the lower end 108 of the spacer 36 corresponds with the raised position of the drive module 14 with respect to the pivot bracket 54. As interaction with the spacer 36 ends as the drive module 14 reaches the raised position, the locking pin 102 shifts (e.g. is pushed by the locking spring 104) further toward the longitudinal axis A, to an unlocked position. When the locking pin 102 extends toward the longitudinal axis A, the locking pin 102 may disengage from the catch 70. The locking pin 102 is then able to travel along the arcuate guide surface 72 of the mounting bracket 52 as the pivot bracket 54 is rotated until the locking pin 102 abuts the stop 74. A fully stowed position of the drive module 14 may be defined as the position where the locking pin 102 abuts the stop 74.

To return from the stowed position to the raised position, and then to the in-use position, the user may rotate the drive module 14, particularly the actuation portion 16, toward themselves until the drive module reaches a substantially vertical position as defined by the longitudinal axis A. When the drive module 14 reaches vertical, the locking pin 102 may contact a stop surface 110 on the mounting bracket 52. The drive module 14 is then converted from the raised position to the in-use position by pressing downwardly as discussed above.

In one embodiment, the locking pin 102 is driven into engagement with the catch 70 as the drive module 14 travels downward toward the in-use position. The engagement of the locking pin 102 with the catch 70 may limit rotation of the pivot bracket 54 when the drive module 14 is not fully raised. In one example, the lower end 108 of the spacer 36 may have a ramped abutment surface 112 to interact with the locking pin 102. The abutment surface 112 forces the locking pin 102 away from the longitudinal axis A as the locking pin meets the spacer 36 when the drive module 14 is being lowered. The abutment surface 112 provides a force in opposition to the locking spring 104 to press the locking pin 102 outwardly away from the longitudinal axis A. The outward displacement of the locking pin 102 caused by the abutment surface 112, and later the outer surface 114 of the spacer 36, as the drive module 14 is lowered, forces the locking pin 102 into the catch 70.

Figure 10:
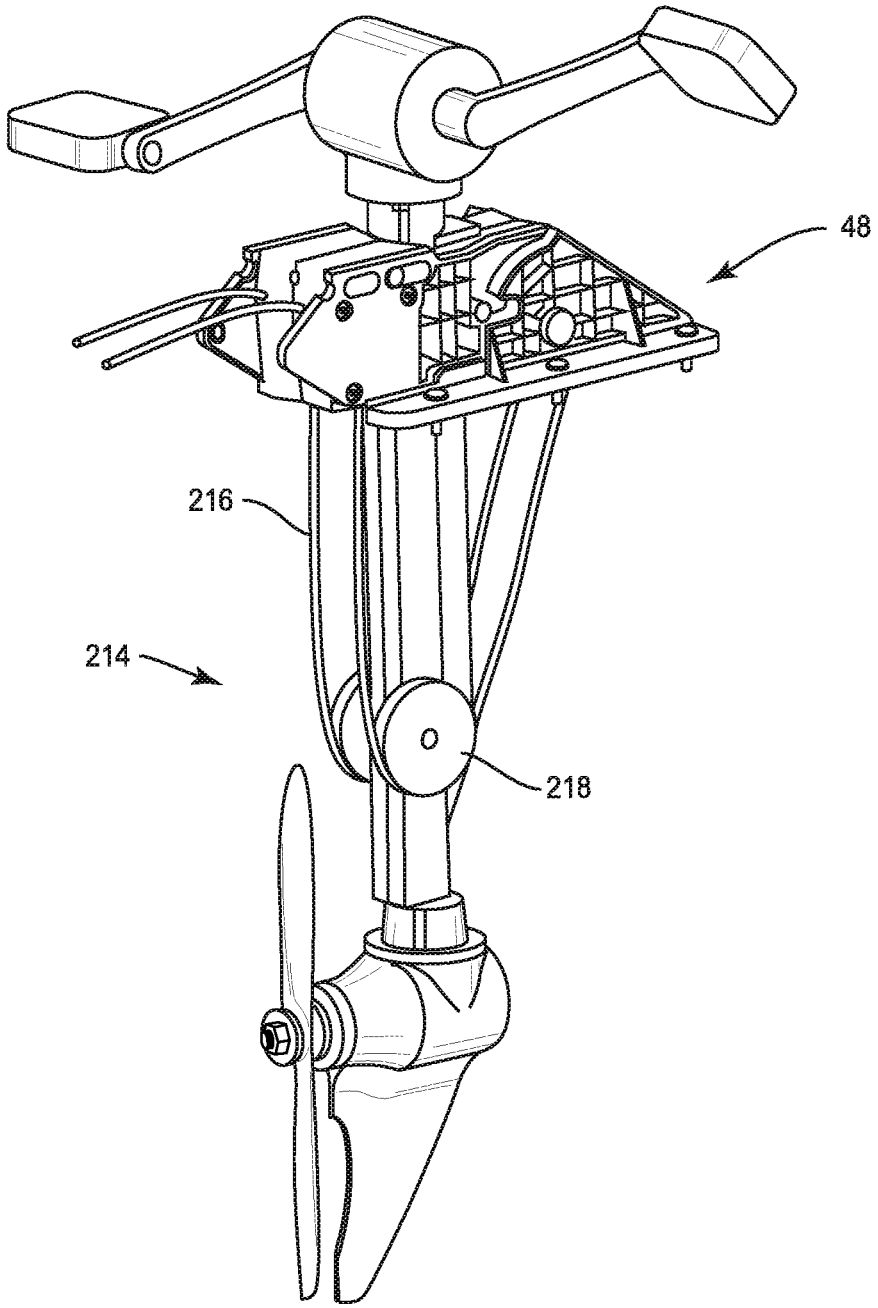
FIG. 10 shows another embodiment of the propulsion system with a rope and pulley assisted lift system.

Having described the illustrated embodiment within FIGS. 1-9, several alternative configurations and alternatives are envisioned for functions, elements and aspects of the propulsion system described above. FIG. 10 shows an embodiment of a drive module 214 having one or more pull ropes 216 led through the mount 48 and around one or more pulleys 218 attached to the drive module. The pull ropes 216 may be used in addition to the constant force spring 100 when the constant force spring otherwise assists with lifting the drive module 214. The pull ropes 216 may also be used as the sole means to raise the drive module 214 from the in-use position to the raised position. The pull ropes 216 may be led through cleats (not shown) that are attached to the mount 48 in order to secure the pull ropes in place as is known in the watercraft art. In other words, the cleats would prevent the weight of the drive module 214 from being sufficient to cause the drive module to inadvertently fall back into the in-use position from the raised position.

Figure 11A:
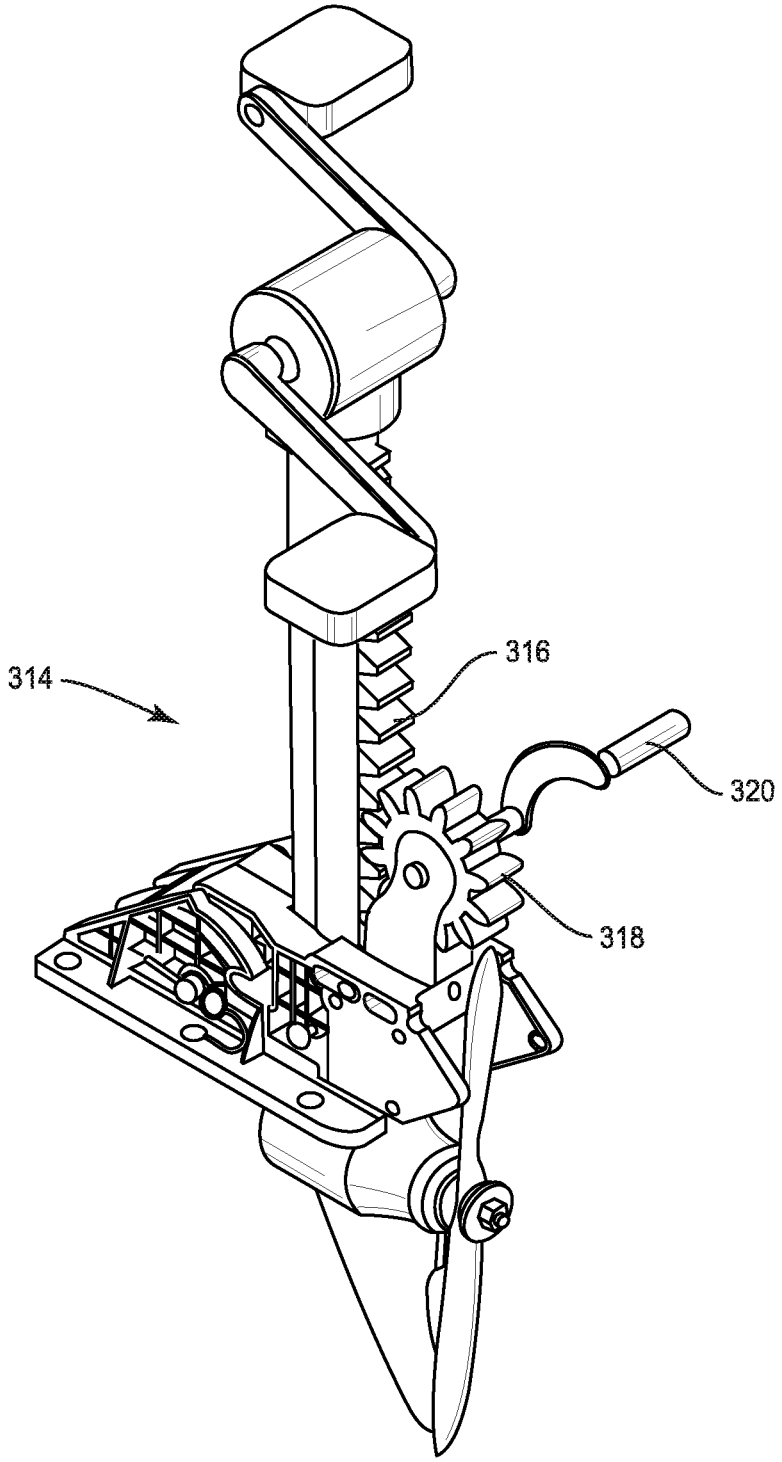
FIGS. 11A and 11B show other embodiments of the propulsion system with a manual and motorized rack and pinion lift system respectively.
Figure 11B:
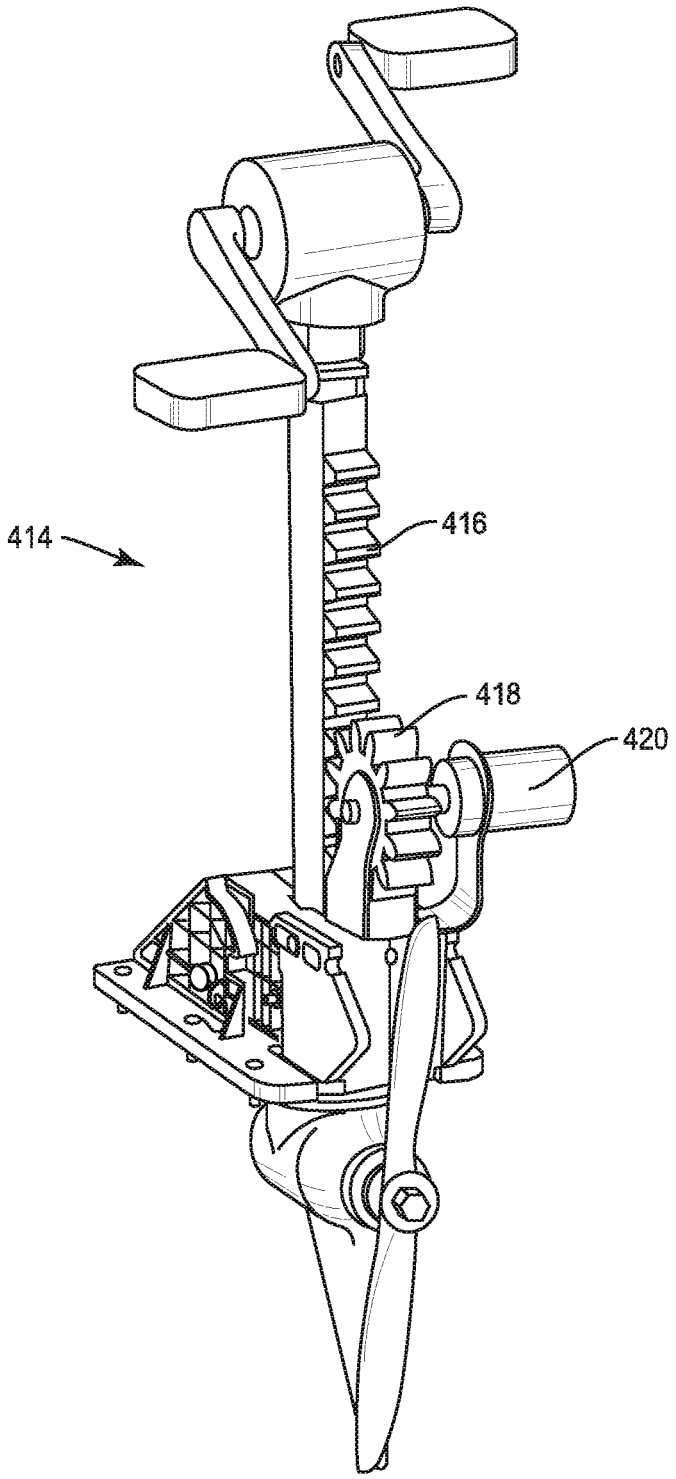

FIGS. 11A and 11B show embodiments of a drive module 314, 414 with a rack 316, 416 attached to the intermediate portion 22 and engaged with a pinion gear 318, 418. The pinion gear 318, 418 may be supported upon a portion of the mount 48, such as the pivot bracket 54. In FIG. 11A, the pinion gear 318 is operated with a handle 320. In FIG. 11B, the pinion gear 418 is operated in a motorized fashion with a motor 420. The resulting rack and pinion lifting system may be used in addition to the constant force spring 100 when the constant force spring otherwise assists with lifting the drive module 314, 414. The rack and pinion system may also be used as the sole means to raise the drive module 314, 414 from the in-use position to the raised position.

Figure 12:
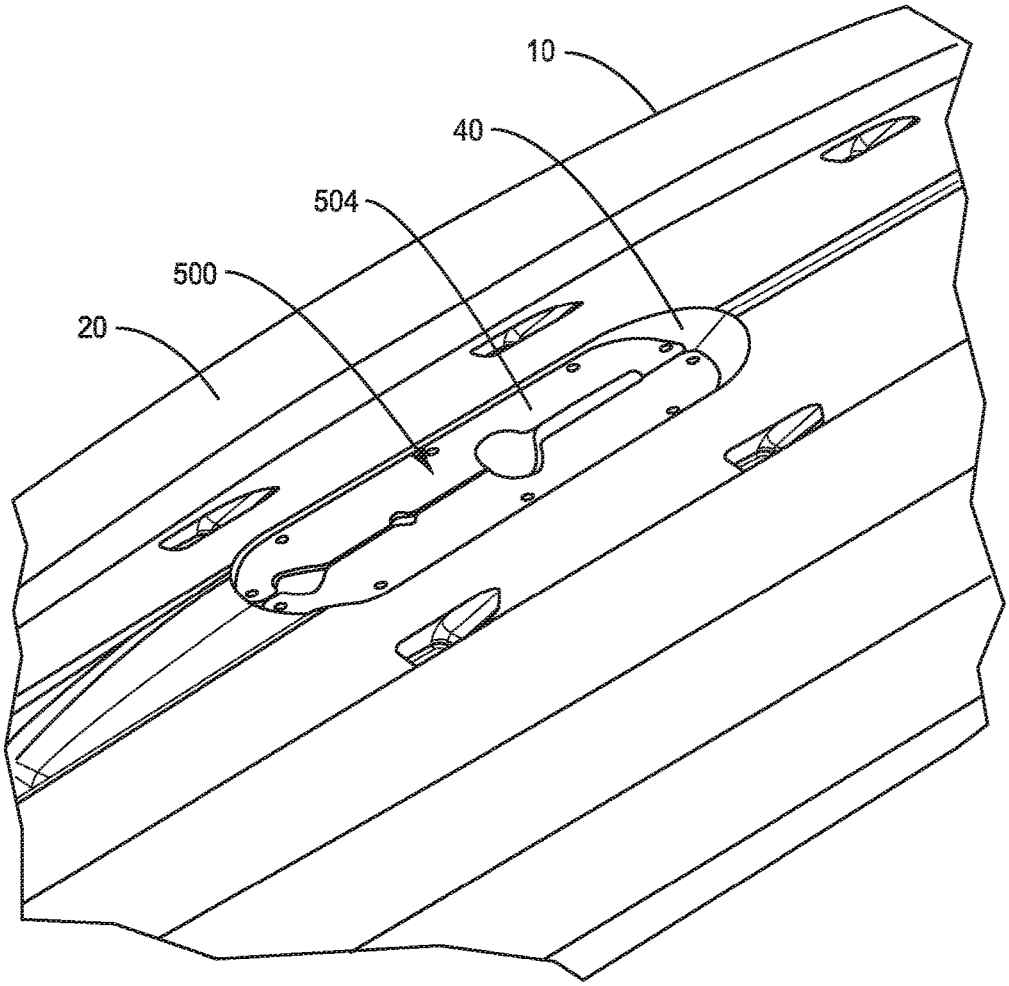
FIG. 12 shows an underside perspective view of the watercraft with optional features applied to the hull.

Turning to FIG. 12, additional optional features of the watercraft 10 are now described. FIG. 12 is an underside perspective view of the hull 20. As should be understood from above, the scupper 40 of the present disclosure exits the bottom the hull 20 in a location that would be below the expected waterline of the watercraft 10. As a result, water at least partially fills the scupper 40. Turbulence created by the water flow circulating within the scupper 40 tends to slow the hull speed of the boat and create noise within the water, which may scare away fish. Because of the large size of the scupper 40 required to accept the drive module described above, the loss of speed and increased noise may have a significant impact on the user's experience. Additionally, the water flow within the scupper 40 cases air to mix into the water from the surface. When the propeller blades act upon aerated water, the thrust imparted by the blades is less efficient than if the blades had engaged water that did not include air bubbles. To address these concerns while still providing for the drive module to raise and lower relative to the scupper 40, a scupper cover 500 may be attached at or near the bottom opening of the scupper. In one embodiment, the scupper cover 500 is a flexible material that limits water flowing along the hull 20 from entering the scupper 40 and causing significant turbulent flow. The scupper cover 500 may comprise a pair of flexible flaps 504, such as rubber flaps, as shown. The flaps 504 are configured to flex, forming a gap to accept portions of the drive module passing therethrough. Instead of rubber flaps, a pair of opposing bushes may make up the scupper cover 500. In another embodiment, the scupper cover 500 is a single web of rubber or woven material formed with a split opening. The scupper cover 500 is configured to flex or bend as portions of the drive module pass from substantially inside the scupper 40 to below the hull 20. The scupper cover 500 may be structurally fixed to the hull 20 with rivets, screws, adhesive, or other bonding methods such as over-molding. With use of the optional scupper cover 500, water passing along the hull 20 maintains a more laminar flow below the scupper 40 when the drive module is in the in-use position, the zero-draft position, and the stowed position. As a result, the watercraft 10 may be able to provide increased hull speed, reduced noise and more efficient thrust due to limiting aeration.

A watercraft 10 with a scupper cover 500 may be described in terms of the following paragraphs:

Paragraph A: A kayak, comprising:

a hull;

a scupper passing through the hull;

a propulsion system at least partially disposed within the hull in at least an in-use position; and a scupper cover attached to the hull adjacent to a bottom opening of the scupper.

Paragraph B: The kayak of paragraph A, wherein the scupper cover comprises at least two flexible rubber flaps configured to provide a gap therebetween for receiving a portion of the propulsion system.

Paragraph C: The kayak of paragraph A, wherein the scupper cover comprises a pair of opposing brushes configured to provide a gap therebetween for receiving a portion of the propulsion system.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A mount for mounting a drive module to a watercraft, the mount comprising:

a frame configured to be attached to the watercraft and configured to attach to the drive module to selectively allow the drive module to linearly translate from a first position to a second position, wherein, when in the first position, the drive module is capable of propelling the watercraft, and wherein the frame comprises:

a retainer to fix the drive module in the first position, and a first spring to assist linear translation of the drive module toward the second position, the second position being raised relative to the first position, wherein the frame comprises a mounting bracket configured to be attached to the watercraft and a pivot bracket removably and pivotably attached to the mounting bracket by a pivot pin, the pivot bracket configured for being attached to the drive module, wherein the pivot bracket is configured to selectively allow the drive module to pivot from the second position to a third position and vice versa.

2. The mount of claim 1, wherein the frame further comprises:

a release operably connected to the retainer, wherein the first spring is configured to move the drive module from the first position toward the second position upon actuation of the release.

3. The mount of claim 2, wherein the release comprises a foot lever pivotably attached to the frame.

4. The mount of claim 1, wherein the retainer is configured to engage a notch in the drive module, and comprises:

a pin, and a second spring configured to bias the pin toward the notch.

5. The mount of claim 1, wherein the pivot bracket further comprises a lock configured to prevent the pivot bracket from pivoting relative to the mounting bracket until the drive module is translated to the second position.

6. The mount of claim 5, wherein the lock comprises a second spring biasing a locking pin.

7. The mount of claim 6, wherein the second spring biases the locking pin toward an unlocked position such that the locking pin shifts to the unlocked position when the drive module reaches the second position.

8. The mount of claim 5, wherein the mounting bracket comprises a catch to engage the lock in a locked position.

9. A propulsion system for a watercraft, the propulsion system comprising:

a drive module, the drive module comprising:

an actuation portion accessible to a user for receiving an input, a propulsion portion having at least one blade to propel the watercraft in response to the input, and an intermediate portion between the actuation portion and the propulsion portion, the intermediate portion capable of extending at least partially through the watercraft; and a mount for mounting the drive module to the watercraft, the mount comprising:

a frame configured to be attached to the watercraft and configured to attach to the intermediate portion of the drive module to selectively allow the drive module to linearly translate from a first position to a second position, wherein the frame comprises:

a retainer to fix the drive module in the first position, and a first spring to assist linear translation of the drive module toward the second position.

10. The propulsion system of claim 9, wherein the frame further comprises:

a release operably connected to the retainer, wherein the first spring is configured to move the drive module from the first position toward the second position upon actuation of the release.

11. The propulsion system of claim 10, wherein the release comprises a foot lever pivotably attached to the frame.

12. The propulsion system of claim 9, wherein the retainer is configured to engage a notch in the drive module, and comprises:

a pin, and a second spring configured to bias the pin toward the notch.

13. The propulsion system of claim 9, wherein the frame comprises a mounting bracket configured to be attached to the watercraft and a pivot bracket removably and pivotably attached to the mounting bracket by a pivot pin, the pivot bracket attached to the drive module, wherein the pivot bracket selectively allows the drive module to pivot from the second position to a third position and vice versa.

14. The propulsion system of claim 13, wherein the pivot bracket further comprises a lock configured to prevent the pivot bracket from pivoting relative to the mounting bracket until the drive module is translated to the second position.

15. The propulsion system of claim 14, wherein the lock comprises a second spring biasing a locking pin.

16. The propulsion system of claim 15, wherein the second spring biases the locking pin toward an unlocked position such that the locking pin shifts to the unlocked position when the drive module reaches the second position.

17. The propulsion system of claim 14, wherein the mounting bracket comprises a catch to engage the lock in a locked position.

18. A watercraft, comprising:

a shell having a hull;

a scupper passing through the hull; and a propulsion system, comprising:

a drive module, the drive module comprising:

an actuation portion accessible to a user for receiving an input, a propulsion portion having at least one blade to propel the watercraft in response to the input, and an intermediate portion between the actuation portion and the propulsion portion, the intermediate portion capable of extending at least partially through the watercraft; and a mount for mounting the drive module to the watercraft, the mount comprising:

a frame configured to be attached to the watercraft and configured to attach to the intermediate portion of the drive module to selectively allow the drive module to a transition from a first position to a second position, wherein the frame comprises:

a retainer to fix the drive module in the first position, and a first spring to assist the transition of the drive module toward the second position, wherein:

the frame is attached to the shell adjacent to the scupper, the first position is an in-use position where the intermediate portion extends through the scupper and the propulsion portion extends below the hull, and the second position is a raised position with the propulsion portion substantially located within the scupper.

19. The watercraft of claim 18, wherein the frame comprises a mounting bracket attached to the watercraft and a pivot bracket removably and pivotably attached to the mounting bracket by a pivot pin, the pivot bracket attached to the drive module, wherein the pivot bracket selectively allows the drive module to pivot from the second position to a third position and vice versa.

20. The watercraft of claim 19, wherein the third position is a stowed position, wherein, in the stowed position, no portion of the drive module is within the scupper.

21. The watercraft of claim 18, wherein the drive module is removable from the watercraft.

22. The watercraft of claim 18, further comprising a scupper cover attached to the hull adjacent to a bottom opening of the scupper.

* * * * *